US006040244A

United States Patent [19]

Arai et al.

[11] Patent Number: 6,040,244

[45] Date of Patent: Mar. 21, 2000

[54] POLISHING PAD CONTROL METHOD AND APPARATUS

[75] Inventors: Hatsuyuki Arai; Yasushi Ikeyama, both of Kanagawa, Japan

[73] Assignee: Speedfam Co., Ltd., Tokyo, Japan

[21] Appl. No.: 08/927,314

[22] Filed: Sep. 11, 1997

[30] Foreign Application Priority Data

Sep. 11, 1996 [JP] Japan ..... 8-262575

[51] Int. Cl.[7] ..... H01L 21/302

[52] U.S. Cl. ..... 438/691; 438/692

[58] Field of Search ..... 438/691, 692, 438/693

[56] References Cited

U.S. PATENT DOCUMENTS

| | | | |
|---|---|---|---|
| 5,081,051 | 1/1992 | Mattingly et al. | 438/693 |
| 5,609,718 | 3/1997 | Meikle | 156/626.1 |
| 5,618,447 | 4/1997 | Sandhu | 438/14 |
| 5,738,562 | 4/1998 | Doan et al. | 451/5 |
| 5,743,784 | 4/1998 | Birang et al. | 451/21 |
| 5,801,066 | 9/1998 | Meikle | 438/692 |
| 5,834,377 | 11/1998 | Chen et al. | 438/693 |

FOREIGN PATENT DOCUMENTS

| | | |
|---|---|---|
| 63-204110 | 8/1988 | Japan . |
| 08061949 | 3/1996 | Japan . |

*Primary Examiner*—Benjamin L. Utech
*Assistant Examiner*—Duy-Vu Deo
*Attorney, Agent, or Firm*—Snell & Wilmer, LLP; Michael K. Kelly

[57] ABSTRACT

A single sensor 19 simultaneously measures the thickness and contour of a polishing pad 3 before and after polishing to determine changes in the thickness and contour of the polishing pad 3 caused by polishing. Based on these changes, a reproduction signal for pad reproduction or a replacement signal for pad replacement is output from a controlling means 13 to enable the surface accuracy of the polishing pad to be efficiently controlled.

17 Claims, 3 Drawing Sheets

POLISHING PAD CONTROL METHOD AND APPARATUS

FIELD OF THE INVENTION

The present invention relates to a method and apparatus for controlling a polishing pad adhered to a surface plate of a plane polishing apparatus.

PRIOR ART

Plane polishing apparatuses for polishing a semiconductor wafer generally include a surface plate with a polishing pad adhered to its top surface and a carrier that grips a wafer to be polished, wherein the carrier lowers while rotating in order to press the held wafer against the polishing pad on the rotating surface plate for polishing.

In such a polishing process, the flatness of the wafer obtained after polishing is very important and is evaluated using the following as an indicator: the total change in the thickness of bare wafers, the uniformity of the remaining films, a reduction in the number of stages, or the flatness of wafers with inter-layer insulating or metallic films after polishing. These indicators are important elements that determine the yield of bare or device wafers.

Polishing is also called "transfer" according to the processing classification, in that the flatness of the surface plate to which the polishing pad is adhered or the flatness of the polishing pad surface directly transfers to the flatness of the wafer after polishing. For example, if the surface plate or the polishing pad has a recessed surface, the wafer is polished into a protruding surface, whereas if the surface plate or the polishing pad has a protruding surface, the wafer is polished into a recessed surface.

Thus, to increase the flatness of wafers after polishing, the surface accuracy of the surface plate and the polishing pad must be increased. Since, however, the surface accuracy of the surface plate has been substantially increased by having its expansion reduced, and in actual polishing the wafer contacts the polishing pad for polishing, attention must rather be paid to the surface accuracy of the polishing pad. Particularly, improved accuracy control is required for those polishing pads that comprise non-woven fabric or foaming urethane and which have a relatively high hardness.

In general, the surface of the polishing pad is worn out and deformed due to the wafer polishing process. Thus, a grindstone-like reproduction tool called a "pad conditioner" or a "dresser" is normally used to provide conditioning after a constant number of cycles in order to cut degraded layers off from the surface of the polishing pad, thereby reproducing the contour and surface roughness of the pad. Particularly, in a process for processing device wafers called CMPs, not only the contour of the polishing pad but also its surface roughness are attracting attention as important elements that affect the finish.

In addition, since the polishing pad is worn out over time due to polishing and conditioning, it must be replaced when its wear exceeds a specified limit.

Thus, to strictly control the surface accuracy of the polishing pad, the interval at which the surface should be reproduced or the pad should be replaced must be accurately known. In order to do this, changes in the shape and thickness of the surface of the polishing pad must be measured over time.

No means, however, has been proposed that can simultaneously, simply, and inexpensively measure changes in the shape and thickness of the surface of the polishing pad.

For example, Japanese Examined Publication No. Heisei 8-61949 discloses an apparatus that uses two sensors to simultaneously measure the contours of the surface plate and the polishing pad. In this apparatus, however, one of the sensors measures the contour of the surface plate while the other measures the contour of the polishing pad, and these contours are not measured simultaneously with the thickness of the polishing pad. Consequently, the interval at which the surface must be reproduced can be known but the interval at which the pad must be replaced cannot be known. Furthermore, the use of two sensors significantly increases the costs of the apparatus.

DISCLOSURE OF THE INVENTION

This invention is intended to provide a simple and inexpensive means that can simultaneously measure changes in the contour and thickness of a polishing pad caused by polishing, in order to enable the surface accuracy of the pad to be efficiently controlled.

To achieve this object, a first controlling method according to this invention is characterized in that it comprises using a sensor to scan the surface of a surface plate in its radial direction prior to the adhesion of a polishing pad, in order to measure the position of the surface plate's surface, and setting into a controlling means that position as a reference surface used to measure the thickness of the polishing pad; adhering the polishing pad to the surface of the surface plate; using the sensor to measure the initial contour and thickness of the polishing pad prior to processing and the contour and thickness thereof after processing; and based on the differences between the pre- and post-processing contour and thickness, outputting from the controlling means a reproduction signal for surface reproduction or a replacement signal for pad replacement.

In addition, a second controlling method according to this invention is characterized in that it comprises forming an exposed portion from which the surface plate surface is exposed, at least one end of the surface plate in its radial direction after the polishing pad has been adhered; using the sensor to scan the surface plate in its radial direction, starting from the exposed portion in order to measure the thickness of the polishing pad based on the positions of the surface plate's surface and the pad surface and also to measure the contour of the pad; and based on changes in the contour and thickness of the polishing pad before and after polishing, outputting from the controlling means a reproduction signal for pad surface reproduction or a replacement signal for pad replacemnt.

The controlling method according to this invention may include the step of using the sensor to also measure the surface roughness of the polishing pad before and after processing and, depending on any change in surface roughness, outputting from the controlling means a reproduction signal for pad surface reproduction.

This invention can be configured so that, in response to the reproduction signal output from the controlling means, a reproduction means including a dresser automatically reproduces the surface of the polishing pad.

A controlling apparatus according to this invention is characterized in that it comprises a single sensor for detecting the surface positions of both the surface plate and the polishing pad adhered to the surface plate, in order to measure the thickness of the polishing pad and the contour of the polishing pad surface; a moving means for moving the sensor in the radial direction of the surface plate; and a controlling means including a function for outputting a reproduction signal for surface reproduction depending on the change in the contour of the polishing pad surface before and after polishing obtained from measured data from the sensor, and a function for outputting a replacement signal for pad replacement depending on any change in the thickness of the polishing pad before and after polishing.

According to this invention, the sensor may have a function for measuring the surface roughness of the pad, and the controlling means may output a reproduction signal for surface reproduction depending on a change in surface roughness.

In addition, a reproduction means including a dresser may be provided so that, in response to the reproduction signal from the controlling means, the reproduction means is operated to reproduce the surface of the pad.

DETAILED DESCRIPTION

Figure 1:
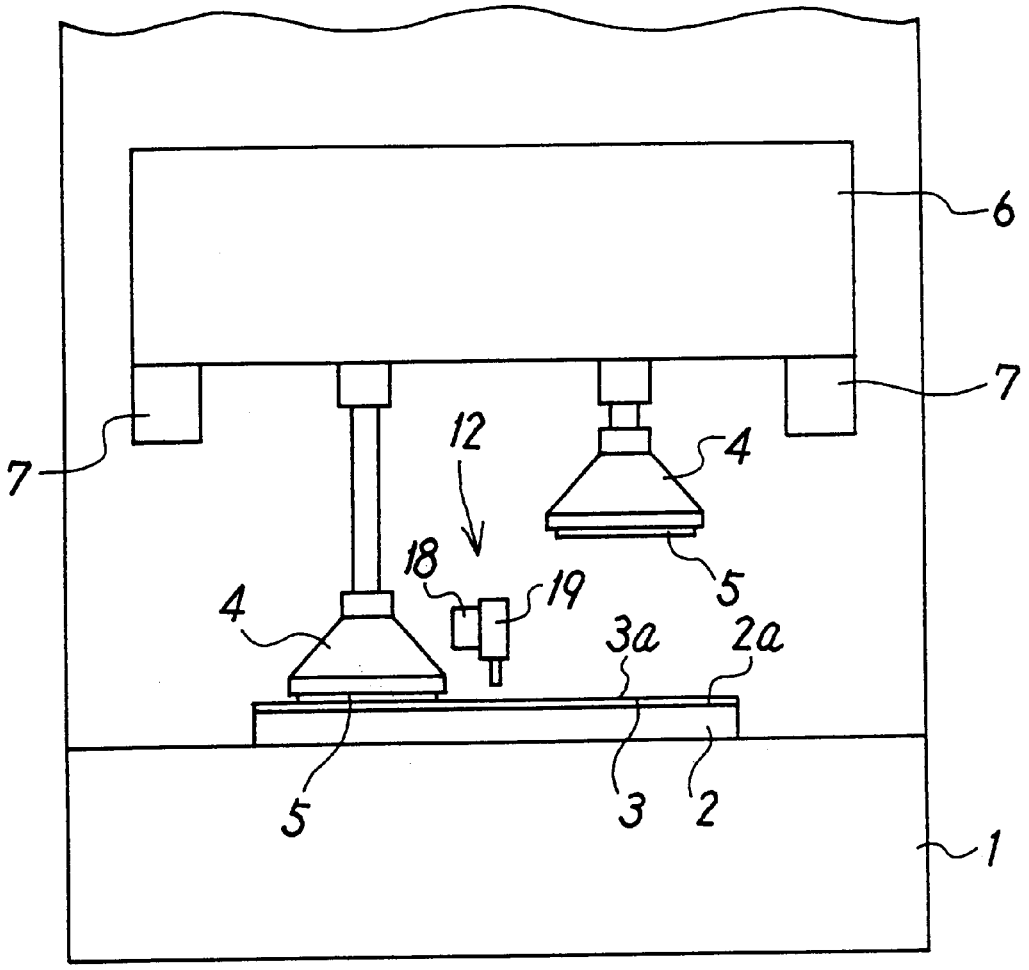
FIG. 1 is a front view schematically showing the integral part of a plane polishing apparatus including a controlling device according to this invention.
Figure 2:
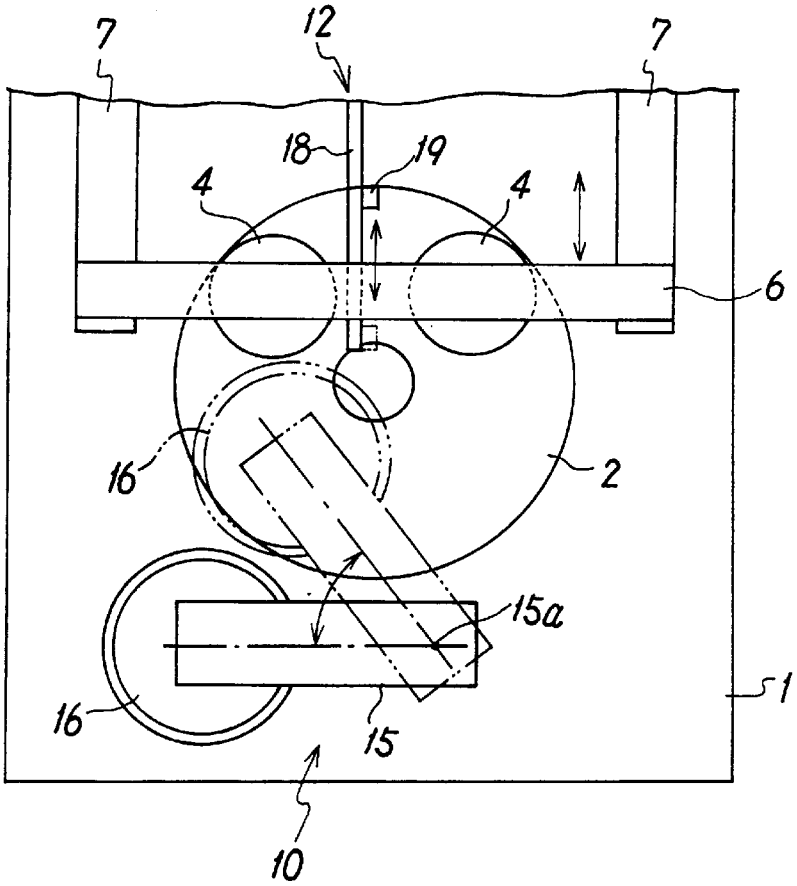
FIG. 2 is a plan view of the integral part of FIG. 1.

The embodiments of this invention are described below with reference to the drawings. FIGS. 1 and 2 schematically show the integral part of a single-side polishing apparatus including a controlling device according to this invention. Reference numeral 1 designates a body; 2 is a surface plate mounted on the body 1 and rotatably driven by a motor; 3 is a polishing pad comprising non-woven fabric or foaming urethane adhered to the surface (the surface plate surface) 2*a* of the surface plate 2; 4 are carriers that hold a wafer 5 to press it against the surface plate 2; 6 is a supporting plate that supports the carriers 4 so that they can be elevated and lowered and rotatably driven by a motor; and 7 are rails that guide the movement of the supporting member 6. In this polishing apparatus, when the carriers 4 holding the wafer 5 in their loading position (not shown) are moved to above the surface plate 2 along the rails 7, they lower while rotating to press the held wafer 4 against the polishing pad 3 on the rotating surface plate 2 for polishing.

Figure 3:
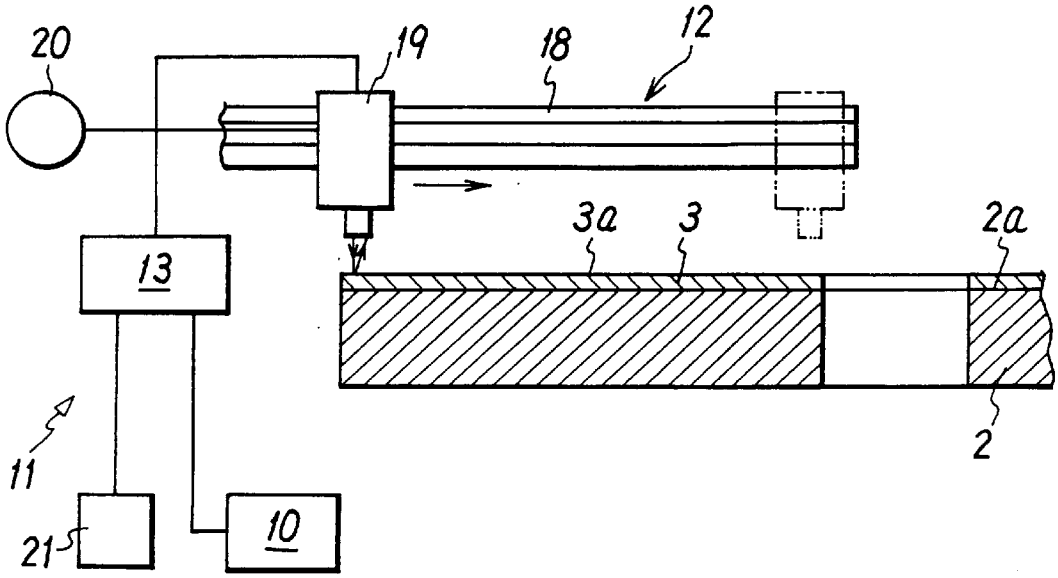
FIG. 3 is an enlarged cross sectional view of the integral part of FIG. 1.

The body 1 of the polishing apparatus includes a reproduction means 10 for reproducing (conditioning) the surface (the pad surface) of the polishing pad 3; and a measuring means 12 for measuring the contour and thickness of the polishing pad 3. The measuring means 12 constitutes a controlling device 11 for the polishing pad 3 together with a controlling means 13, as shown in FIG. 3.

The reproduction means 10 comprises a grindstone-like reproduction tool 16 called a "pad conditioner" or a "dresser" rotatably mounted at the tip of an arm 15 that can be rotated around a supporting shaft 15*a* a specified angle. The reproduction tool is used to cut degraded layers off from the surface of the polishing pad 3 to reproduce the surface nature (contour and surface roughness) of the pad 3, and is disposed at a position that is different from the position at which the wafer 5 held by the carriers 4 is polished.

In addition, the measuring means 12 includes a horizontal support arm 18 disposed between the carriers 4 and 4, and supported by the body 1 so as to be moved back and forth in the radial direction of the surface plate 2 and to be elevated and lowered; a sensor 19 movably mounted on the support arm 18 so as to be moved along the radius of the surface plate 2 and which can measure the positions, shapes, and roughness of the surfaces of the surface plate 2 and the polishing pad 3; and a moving means 20 for moving the sensor.

The sensor 19 comprises a non-contact laser focus displacement gauge. This laser focus displacement gauge irradiates a measured object with laser beams and receives reflected beams to measure the distance to the object. The sensor 19 can be used to scan the surface of the surface plate 2 in its radial direction in order to simultaneously measure the position, contour, and roughness of the surface plate's surface or the pad surface.

The moving means 20 comprises, for example, a pulse motor and a belt. A controlling circuit (not shown) drives the pulse motor to move the sensor 19 back and forth along the arm 18.

The controlling means 13 processes a measured signal from the sensor 19 and outputs a reproduction signal for the reproduction of the surface of the polishing pad 3 and a replacement signal for pad replacement. The thickness of the polishing pad 3 is determined based on the positions of the surface plate and pad surfaces measured by the sensor 19, and the changes in thickness caused by processing is determined. Changes in the contour and surface roughness of the pad surface caused by processing are determined based on the contour and the surface roughness, and based on these changes, the reproduction and the replacement signals are output to a display device 21 and represented in character or voice formats. In this case, the measured data can be continuously displayed on the display device 21.

Next, a first embodiment of a method for controlling the polishing pad 3 using the controlling device 11 that uses the non-contact sensor 19 is described.

Prior to polishing, the support arm 18, which has been in a standby position, moves forward in the radial direction of the surface plate 2, to which the polishing pad 3 has not been adhered. The sensor 19 thus scans the surface of the surface plate 2 in the radial direction to measure the position of the surface plate 2, which is then set in the controlling means 13 as a reference surface used to measure the thickness of the polishing pad 3. The reference surface is measured at one or more positions of the surface plate surface 2*a* along the radius of the surface plate 2 so that the average of measured values obtained at the plurality of points on the radius can be used as the reference surface in this radial position.

Next, the polishing pad 3 is adhered to the surface of the surface plate 2, and the reproduction means 10 carries out pre-processing conditioning as required. Then, as shown in FIG. 3, the sensor 19 scans the surface of the polishing pad 3 in the radial direction of the surface plate 2 at the same positions used for measurement of the reference surface, in order to measure the initial contour and surface roughness of the pad surface 3*a*. The position of the pad surface is simultaneously measured as an average, and the initial thickness of the polishing pad 3 is measured based on the position of the pad surface relative to the reference surface.

Once the initial contour, surface roughness and thickness of the polishing pad 3 has been saved to the controlling means 13, polishing is initiated. In this polishing, the carriers 4 receive the wafer 5 in its loading position (not shown), moves to above the surface plate 2 along the rails 7, and then lowers while rotating to press the held wafer 5 against the polishing pad 3 on the rotating surface plate 2.

Once a required number of wafers 5 have been polished, the sensor 19 scans the surface of the polishing pad 3, which is stopped at a predetermined rotating position, in the radial direction of the surface plate 2 at the same positions used for measurement of the initial data, in order to measure the contour and surface roughness of the pad surface after polishing and the thickness of the polishing pad 3. These measurements are made each time a set number of wafers 5 are polished.

The term "after processing" used in reference to this invention refers to the conditions "after the initiation of polishing" but does not necessarily refer to the conditions after a specified number of wafers have been completely processed. In addition, this term does not depend on whether the surface plate is rotating for polishing or is stopped for wafer replacement.

The measured data is compared by the controlling means 13 to the data for initial contour, surface roughness, and thickness obtained prior to processing to determine the changes in these characteristics associated with processing. When the change in contour and/or surface roughness exceeds a specified allowable limit, the controlling means 13 outputs a reproduction signal for surface reproduction to the display device 21. In addition, when the change in thickness exceeds a specified allowable limit, the controlling means 13 outputs a replacement signal for pad replacement to the display device 21. These signals are represented in voice form or as characters on the display device 21.

In this case, the reproduction signal can be output to the reproduction means 10 to operate the means 10 in order to automatically condition the pad surface.

The measured data obtained before and after processing can be directly displayed on the display device 21.

Thus, the surface accuracy of the polishing pad 3 can be strictly controlled by measuring changes in the contour, and surface roughness and thickness of the polishing pad 3 caused by polishing, and by outputting the pad reproduction and the pad replacement signals.

Furthermore, since the single sensor 19 can simultaneously measure the contour, surface roughness, and thickness, the accuracy can be controlled simply and inexpensively compared to conventional methods using a plurality of expensive sensors.

Although the first embodiment measures the contour, surface roughness, and thickness of the polishing pad 3 after polishing while the surface plate 2 is stopped at a constant position, this measurement can be executed while the surface plate 2 is rotating. That is, by moving the sensor 19 in the radial direction of the rotating surface plate 2 during polishing, the nature of the surface of the polishing pad 3 can be measured at spirally positioned measuring points. In this case, data measurements can be continuously obtained by repeating the above measurements in one or both of the travelling directions while moving the sensor back and forth in the radial direction of the surface plate.

As a result, measured data can be virtually obtained for the overall surface of the polishing pad 3, in order to accurately determine the degree of the wear on the pad surface caused by polishing and associated changes in contour and surface roughness, thereby enabling accuracy to be controlled more efficiently.

The controlling device 11 can control reproduction conditions for the pad surface by the reproduction means 10. As described above, when the controlling means 13 outputs the reproduction signal, the reproduction means 10 is operated to reproduce the surface of the polishing pad 3. During reproduction, the contour and surface roughness of the pad surface can be measured by using the sensor 19 to scan the surface of the polishing pad 3 in the radial direction of the surface plate 2 while the plate is rotating or stopped. If the measurement is carried out while the surface plate is stopped, it is desirably executed at the same positions as when the initial data was measured.

The measured data obtained is compared to the initial contour and surface roughness of the pad surface prior to processing. When the difference between this data and the initial data becomes less than a specified allowable limit in contour and/or surface roughness, the controlling means 13 outputs to the display device 21 a reproduction-end signal causing reproduction to be finished. This signal is given either as a voice signal or as characters on the display device 21. The reproduction means 10 is then stopped.

Thus, using the controlling device 11 to control the process for reproducing the pad surface, an appropriate pad surface can always be reproduced without providing excessive or insufficient conditioning, thereby improving reproduction efficiency and accuracy.

Figure 4:
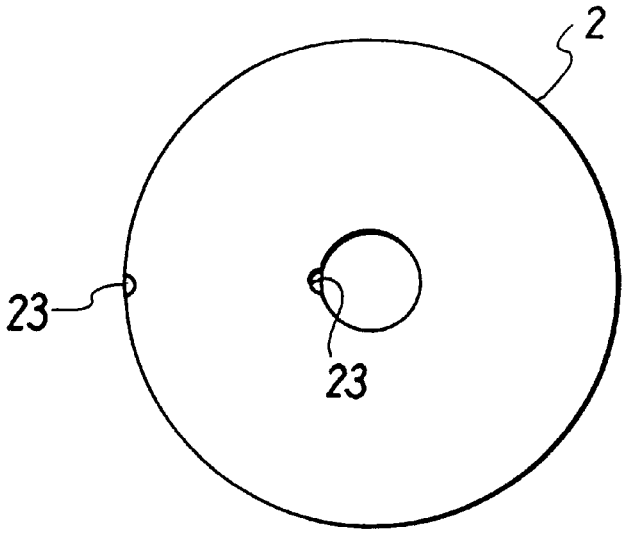
FIG. 4 is a plan view of a surface plate used for a different embodiment of a controlling method according to this invention.
Figure 5:
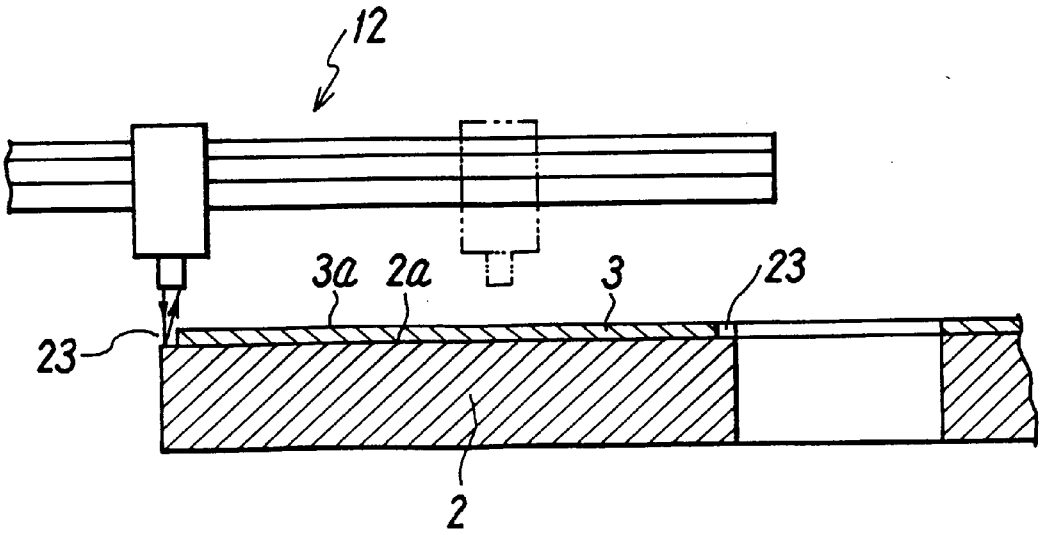
FIG. 5 is an enlarged cross sectional view of the integral part of FIG. 4.

FIGS. 4 and 5 show a second embodiment of a method for controlling the polishing pad 3 using the controlling device 11 that uses the non-contact sensor 19.

According to the second embodiment, the polishing pad 3 is cut to form an exposed portion 23 from which the surface plate surface is exposed, at both radial ends of the surface plate 2 with the polishing pad 3 adhered thereto.

Prior to polishing, while the surface plate 2 is stopped or rotating, the sensor 19 scans the surface of the surface plate between the inner and the outer exposed portions 23 and 23 in the plateUs radial direction, to measure the positions of the surface plate's surface and the pad surfaces at their exposed portions. Based on these positions, the initial thickness, contour, and surface roughness of the polishing pad 3 are measured.

Subsequently, while the wafer 5 is being processed, the sensor 19 is used to scan the surface of the surface plate 2 between the inner and the outer exposed portions 23 and 23 in the plateUs radial direction in order to measure the thickness, contour, and surface roughness of the polishing pad 3 after processing. The results of the measurements are compared to the initial data.

When the change in contour and/or surface roughness exceeds a specified allowable limit, the controlling means 13 outputs to the display device 21 a replacement signal for pad surface replacement, which is represented as a voice signal or as characters on the display device 21.

In this case, the step for obtaining initial data on the polishing pad 3 prior to the polishing of the wafer 5 may be omitted, and measured data obtained immediately after the initiation of polishing may be used as initial data and compared to measured data obtained after processing.

Although this example measures the thickness, contour, and surface roughness of the polishing pad while the surface plate 2 is rotating, the measurement can be executed while the surface plate is stopped at a specified position.

Furthermore, the position of the surface plate's surface may be measured at the exposed portions each time the sensor is moved in the radial direction of the surface plate, thereby allowing the thickness of the polishing pad to be measured using this position as a reference.

The exposed portion formed by partially cutting the polishing pad 3 may be formed at only one of the inner and the outer radial positions.

According to the second embodiment, the reproduction conditions for the pad surface by the reproduction means 10 can be controlled in substantially the same manner as in the first embodiment.

Although each of the above embodiments use a non-contact sensor, a contact sensor may be used. Such a contact sensor may be a publicly known thickness gauge that includes at its tip a contact. This contact contacts the surface plate or the pad surface to scan the surface in the radial direction of the surface plate, thereby enabling the contour of the surface plate and the contour and thickness of the polishing pad to be measured.

Due to the lack of any capability to measure surface roughness, the accuracy-controlling method using a contact sensor cannot accurately control the surface roughness of the pad surface. The other functions of this method, however, are substantially the same as in the first embodiment, so their description is omitted to avoid duplication. In this case, however, measurements are desirably executed while the surface plate is stopped at a specified position.

In addition, in the above embodiments, the support arm 18 supporting the sensor 19 is mounted on the body 1 so as to be moved back and forth and moves forward along the radius of the surface plate 2 during measurements. Furthermore, the measuring means 12 may be formed independently of the polishing apparatus so as to be installed on the surface plate 2 or at another position during measurements.

Thus, according to this invention, the sensor measures changes in the contour, surface roughness, and thickness of the polishing pad caused by polishing, to cause the controlling means to output the pad surface reproduction and the pad replacement signals, thereby providing efficient control over the surface accuracy of the polishing pad.

Furthermore, since the single sensor can simultaneously measure the surface contour, surface roughness, and thickness, accuracy can be controlled simply and inexpensively compared to conventional methods using multiple expensive sensors.

We claim:

1. A method for monitoring and controlling accuracy of a polishing pad adhered to a surface plate mounted on a machine for polishing wafers comprising the steps of:

scanning a surface of said plate with a sensor, prior to adhesion of said pad to said plate, to measure a position of said plate surface;

inputting said surface position into a controlling means to be used as a reference surface for measuring thickness of said pad;

adhering said pad to said plate surface;

scanning said pad with said sensor prior to polishing to measure pre-polishing thickness and contour of said pad;

polishing said wafers;

scanning said pad with said sensor after polishing to measure post-polishing thickness and contour of said pad; and outputting from said controlling means a pad conditioning signal or a pad replacement signal based on differences between said pre-polishing pad thickness and contour and said post-polishing pad thickness and contour.

2. A method as claimed in claim 1, wherein said sensor also measures pre-polishing and post-polishing surface roughness of said pad and, based on changes in said roughness, said controlling means outputs a pad conditioning signal.

3. A method as claimed in claim 2, wherein said sensor is moved in a radial direction relative to said plate during scanning.

4. A method as claimed in claim 3, wherein said sensor is mounted on a support arm and said arm moves in a radial direction relative to said plate during scanning.

5. A method as claimed in claim 3, wherein said surface position is measured at a plurality of radial locations along said plate, and said reference surface is calculated as an average of said position measurements obtained at said plurality of radial locations.

6. A method as claimed in claim 5, wherein said pre-polishing thickness, contour and surface roughness of said pad are also measured at said plurality of radial locations along said plate and calculated as an average of said measurements.

7. A method as claimed in claim 2, wherein said post-polishing pad contour, thickness and surface roughness are measured while said plate is stopped at a constant position.

8. A method as claimed in claim 2, wherein said post-polishing pad contour, thickness and surface roughness are measured while said plate is still polishing said wafers in order to accurately determine degree of wear of said pad caused by polishing.

9. A method as claimed in claim 2, and further comprising the step of conditioning said pad with a conditioning means in response to said pad conditioning signal.

10. A method as claimed in claim 9, and further comprising the step of scanning said pad with said sensor during conditioning to measure said pad contour and surface roughness, said controlling means outputting an end signal to stop said conditioning means when said contour and roughness have changed a predetermined amount.

11. A method as claimed in claim 2, wherein measured data obtained from said sensor is displayed on a display device in voice or character form.

12. A method for monitoring and controlling accuracy of a polishing pad adhered to a surface plate mounted on a machine for polishing wafers comprising the steps of:

forming said pad such that a portion of said plate is exposed;

scanning said exposed portion of said plate and said pad with a sensor prior to polishing to measure pre-polishing thickness and contour of said pad;

polishing said wafers with said pad;

scanning said exposed portion of said plate and said pad with a sensor after polishing to measure post-polishing thickness and contour of said pad; and outputting from a controlling means a pad conditioning signal or a pad replacement signal based on differences between said pre-polishing pad thickness and contour and said post-polishing pad thickness and contour.

13. A method as claimed in claim 12, and further comprising the step of conditioning said pad with a conditioning means in response to said pad conditioning signal.

14. A method as claimed in claim 12, wherein said sensor also measures pre-polishing and post-polishing surface roughness of said pad and, based on changes in said roughness, said controlling means outputs a pad conditioning signal.

15. A method as claimed in claim 14, wherein the step of forming said pad comprises cutting said pad such that either a radially inner portion of said plate is exposed adjacent an inside diameter of said pad or a radially outer portion of said plate is exposed adjacent an outside diameter of said pad.

16. A method as claimed in claim 14, wherein the step of forming said pad comprises cutting said pad such that a radially inner portion of said plate is exposed adjacent an inside diameter of said pad and a radially outer portion of said plate is exposed adjacent an outside diameter of said pad.

17. A method as claimed in claim 16, wherein said sensor scans said plate and said pad in a radial direction between said radially inner and outer portions of said plate.

* * * * *